US007441990B2

(12) United States Patent
Chiaves

(10) Patent No.: US 7,441,990 B2
(45) Date of Patent: Oct. 28, 2008

(54) PROCESS FOR THE CONSTRUCTION OF A SEGMENT OF AN OPEN-AIR WORK BY PREFABRICATED STRUCTURAL MEMBERS, AND PREFABRICATED STRUCTURAL MEMBER RELATED THERETO

(76) Inventor: Carlo Chiaves, Corso Govone 10, Torino (IT) I-10129

( * ) Notice: Subject to any disclaimer, the term of this patent is extended or adjusted under 35 U.S.C. 154(b) by 0 days.

(21) Appl. No.: 10/550,911

(22) PCT Filed: Mar. 24, 2004

(86) PCT No.: PCT/EP2004/003101

§ 371 (c)(1),
(2), (4) Date: Jun. 20, 2006

(87) PCT Pub. No.: WO2004/085749

PCT Pub. Date: Oct. 7, 2004

(65) Prior Publication Data

US 2006/0239779 A1 Oct. 26, 2006

(30) Foreign Application Priority Data

Mar. 28, 2003 (IT) ..... TO2003A0243

(51) Int. Cl.
*E04C 3/02* (2006.01)

(52) U.S. Cl. ..... 405/134; 52/633; 405/126

(58) Field of Classification Search ..... 405/134, 405/124, 151, 125, 126, 150, 152, 153
See application file for complete search history.

(56) References Cited

U.S. PATENT DOCUMENTS

| | | | | |
|---|---|---|---|---|
| 4,693,634 | A | 9/1987 | Chiaves | 405/126 |
| 5,351,353 | A | 10/1994 | Walters | 14/24 |
| 6,129,484 | A | 10/2000 | Chiaves | 405/134 |

FOREIGN PATENT DOCUMENTS

| | | | |
|---|---|---|---|
| GB | 766 213 | A | 1/1957 |
| WO | WO 85/05653 | A | 12/1985 |
| WO | WO 97/19231 | A | 5/1997 |

*Primary Examiner*—Tara L. Mayo
(74) *Attorney, Agent, or Firm*—Sughrue Mion, PLLC

(57) ABSTRACT

A process for the construction of a segment of an open-air work by prefabricated structural members of reinforcing concrete, includes the steps of arranging first and second prefabricated structural members (18, 19) including an upright portion (22) and at least a cover portion (26), and the phase of installing the two structural members (18, 19) by resting the free ends (20) of the respective upright portions (22) on respective foundation portions (12), in such a manner that the two structural members (18, 19) are arranged symmetrically opposed. Each structural member (18, 19) has a cavity in correspondence of the respective cover portion (26), the cavities of the two structural members (18, 19) constituting a continuous channel (34) in order to allow to form a beam superimposed to the two members (18, 19) and fastened to them, by executing a casting (36) in said continuous channel (34) during the work.

12 Claims, 5 Drawing Sheets

PROCESS FOR THE CONSTRUCTION OF A SEGMENT OF AN OPEN-AIR WORK BY PREFABRICATED STRUCTURAL MEMBERS, AND PREFABRICATED STRUCTURAL MEMBER RELATED THERETO

This is a National Stage entry of International Application PCT/EP2004/003101, with an international filing date of Mar. 24, 2004, which was published as WO 2004/085749 A1, and the complete disclosure of which is incorporated into this application by reference.

BACKGROUND OF THE INVENTION

The present invention generally refers to open-air works, such as road overpasses, underpasses, bridges, artificial tunnels, garages, underground parkings or similar, which are erected on a substantially level area, possibly obtained by the execution of a digging before making the work.

More specifically, the invention refers to open-air works made in a modular manner, that is using a series of segments which have a general portal shape and are installed in succession along an axis of the work, until the desired dimensions of the work are reached.

In particular, the invention relates to a process for the construction of a segment of an open air work by prefabricated structural members of reinforced concrete.

A process of the type defined above is known from EP-A-219 501 and EP-A-861 358. Both these documents refer to the manufacturing of open-air works by virtue of the use of prefabricated modular structural members of the articulated type. These structural members have the advantage of being able to be produced and transported to the place of use in the extended configuration, since their dimensions in this condition do not exceed the limit shape allowed for the road transport. When they are installed, they are raised so as to fold the reinforcing rods projecting between adjacent bodies of each member, until each member reaches its final configuration.

If the span of the work is not wider than approximately 5 m, prefabricated structural members comprising five bodies separated by four articulations can be used. These members are intended to assume, in their installed condition, a portal or overturned-U shape which defines two parallel support uprights and the vault of the work, and allows to realize closed-frame box structures. The use of these structural members requires, after the installation of the prefabricated members, the manufacturing of a base concrete bed or mat in order to incorporate the support feet of the several prefabricated members and the reinforcing rods extending from the end bodies of such members.

If the span of the work is between 5 and 15 m approximately, prefabricated structural members having the shape of a bevelled overturned-L, in the installed condition, are used, which are placed side by side in pairs so that each pair of members constitutes a segment having a portal shape. Each of these prefabricated members comprises three bodies separated by two articulations and rests in an articulated manner through a so-called "static hinge" on a respective continuous foundation plinth. A further "static hinge" is made between the two members which constitute each segment of the work, in such a manner that each segment has a general structure of the triple-hinge arch type, one of which is in the center and two of which are at the base.

SUMMARY OF THE INVENTION

The structures manufactured by means of the known prefabricated elements described above have the advantage of being able to be manufactured in an extremely quick manner and of being at the same time very steady and reliable. In general, the segments of such structures, once installed, form a completely steady unit also before sealing concrete castings between the several bodies which constitute the prefabricated members are executed.

The main object of the present invention is to provide a process for the construction of segments of an open-air work by prefabricated structural members which, in addition to keep the advantages of the structures described above unchanged, allows to achieve a reduction of the costs for the execution of the work.

By virtue of these features, in order to manufacture each segment of the work, it is simply necessary to place side by side two prefabricated structural members and form a concrete casting above them in order to make a beam, so that each segment has a static arch structure of the type having only two hinges each of which is arranged at the base of a respective upright portion of the respective structural member. In this manner, the cover portion of each segment together with the respective beam cast during the work, which is similar to a beam having its ends fixed, bears a positive moment in the middle and negative moments near to the uprights or standards. By virtue of this fact, the maximum bending moments applied to the structure, on the same terms of span and external load, are smaller than those acting on the known structures described above, whereby a structural member according to the invention can be manufactured so as to be less thick and lighter. It is therefore possible to considerably reduce the cost for the execution the work thanks to the material saving which can be achieved during the manufacturing of the single structural members constituting the work. The transportation costs turn out also to be reduced because of the structural members are lighter on the same terms of span and sturdiness of the structure to be manufactured. Moreover, a structure manufactured in this manner allows the waterproofing of the work to be made easier and more reliable, since the upper portion of its cover is completely smooth after the execution of the concrete casting for forming the beam and for finishing.

By virtue of the fact that the structural member of the invention has a cavity at its cover portion, which is intended to receive a portion of a beam cast during the execution of the work above the two symmetrical structural members constituting each segment of the work, the structure of the member itself can be manufactured so that it is thinner and lighter than that of the previously known structural members.

Such a structural member turns out to be particularly advantageous with respect to the known structural members used for manufacturing closed-frame box structures, each of which forms a whole segment of the work, since it has a smaller length and involves therefore smaller overall dimensions during the transportation, above all owing to the fact that it neither requires bearing feet to be incorporated in a base concrete bed of the work which have to be cast after the installation of the members, nor reinforcing rods to allow the connection between the concrete bed and the upright portions of each segment of the work, during the execution of the work.

A structural member according to the invention turns out to be also advantageous with respect to the known structural members intended to form in pairs segments with triple-hinge arch structure, because it has a smaller thickness by virtue of the fact that the segments of the work manufactured in this manner have a structure similar to that one of a double-hinged arch and therefore, on the same terms of span and external load, the maximum bending moments applied to the structure are smaller than those bearing on the previously known members with a three-hinge structure. A material saving, and therefore a reduction of production and transportation costs, corresponds to the smaller thickness of the structural members. Owing to the presence of the beam cast above the two structural members during the execution of the work, each segment of the work is able to bear positive bending moments which have a high value at the middle, and therefore at the zone of the joint between each pair of structural members.

Moreover, thanks to the fact that the cavity made in the cover portion of the bracket body forms a longitudinal channel opened axially in correspondence of its free end, prefabricated members according to the invention can be manufactured with different length by using a same formwork provided with a removable transversal plate which can be positioned according to several axially separated positions in order to form structures having different span, so that the length of the structural member to be manufactured can be limited in the desired manner. This is possible by virtue of the fact that the structural members of the invention lack a transversal wall at the free end of the bracket cover portion, which instead had to be arranged in the previously known structural members in order to delimit the zone in which the central hinge of each segment of the work had to be made.

BRIEF DESCRIPTION OF THE DRAWINGS

Further characteristics and advantages of the invention will turn out to be more clear from reading the following detailed description, which has been provided as a non-limitative example and has been made with reference to the appended figures, in which.

DETAILED DESCRIPTION OF THE INVENTION

Figure 1:
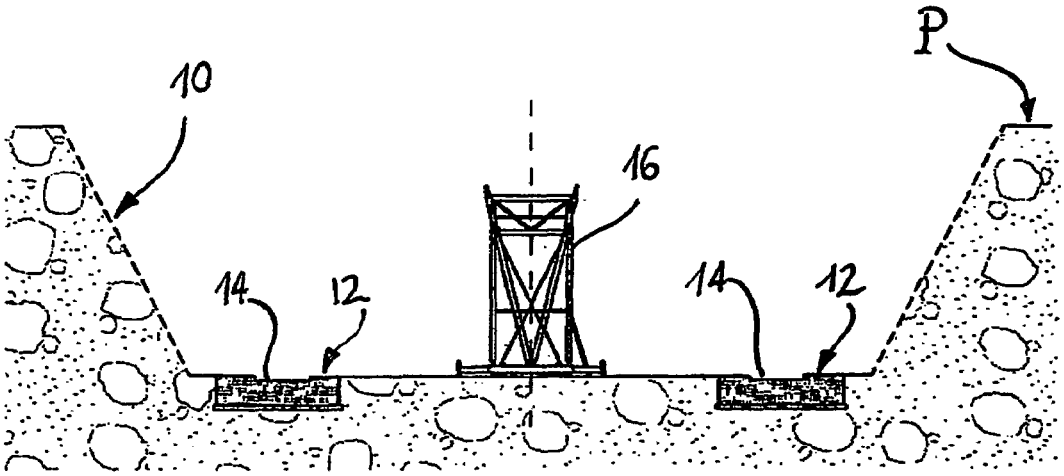
FIGS. 1 and 2 are front elevational views showing a first and a second phase of the manufacturing of a work according to the invention.
Figure 2:
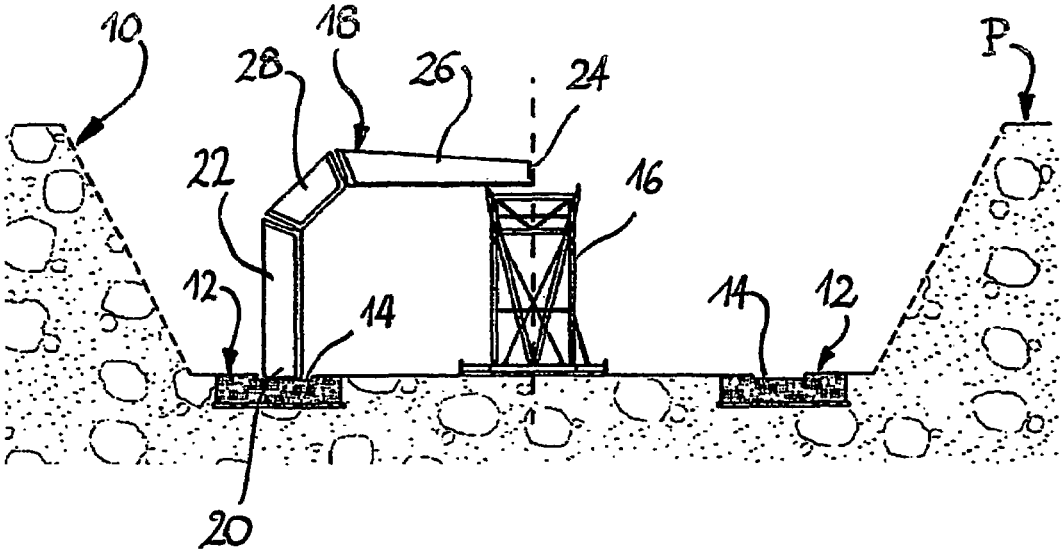

With reference to the figures, an open-air digging executed under the ground level P is generally indicated 10, the execution of which allows to realize an open-air work such as the structure of a highway overpass or an underpass, a bridge, a tunnel or an underground garage.

At the bottom of the digging 10, a base structure of the work is made, for example constituted by a pair of continuous foundation concrete beds 12, each of which has on the top a depressed seat 14. As an alternative, the base structure of the work can be made by means of a single concrete bed, or by two piling heads or other kinds of foundations of a type known per se.

Conveniently, in the zone of the digging between the concrete beds 12, a portable scaffolding or trestle 16 is erected, having the function of a temporary support element for the manufacture of the work, as it will turn out to be more clear in the following of the description.

A first structural member 18 is installed by resting the free end 20 of an upright portion 22 of it in a seat 14 of the respective foundation concrete bed 12, and the free end 24 of a bracket cover portion 26 of it on a counter member of the scaffolding 16.

Likewise, a second structural member 19, equal to the member 18, is installed by resting the free end 20 of its upright portion 22 in the seat 14 of the respective foundation concrete bed 12, and the free end 24 of its bracket cover portion 26 on another counter member of the scaffolding 16, so that its free end 24 is brought into contact with the free end 24 of the other structural member 18. The two structural members 18 and 19, coupled in this manner, form a portal shaped structure for the purpose to constitute a segment 15 of a work defined by a plurality of similar segments 15, arranged in succession along the axis of the work itself.

In order to allow the fine adjustment of the mutual positioning of the members 18 and 19, they can be provided, at their free ends 24, with adjustable extension support members 25, for example constituted by screws engaging respective nut screws fixed to the free ends 24 and having a head which can be used both like a shoulder for the free end 24 of the opposite structural member, and like a control portion of the screw itself. By changing the extension of the members 25 it is therefore possible to reach a resting condition of the members 18 and 19, which is adjusted in an optimal manner.

Preferably, the members 18 and 19 are prefabricated structural members of the articulated type, and each of them includes a plurality of reinforced concrete bodies reciprocally connected by means of main reinforcing rods projecting in the zones located between the adjacent reinforced concrete bodies. In particular, if the members 18 and 19 are articulated prefabricate members, their upright portions 22 are constituted by a first rectilinear end body or upright, and their bracket cover portions 26 are constituted by a second rectilinear end body opposite to the first end body. A slanted portion 28, constituted by a respective rectilinear intermediate body, is interposed between the two bodies constituted by the portions 22 and 26. The bodies constituted by the portions 22, 28 and 26 of each member 18 and 19 can be articulated as a result of the bending of the main reinforcing rods in correspondence of their zones between adjacent reinforced concrete bodies, so as to allow the two structural members 18 and 19 to assume, starting from their extended configuration for the transport, their configuration of installation in the form of an overturned and bevelled "L" or "U".

A static hinge is made in a manner known per se at the free end 20 of the upright portion of the members 18, 19, in order to allow the members 18 and 19 to rest on the respective foundation concrete beds 12 at least with a limited possibility of rotation. To such a purpose, each member 18, 19 has an appendage 21 delimited by a convex cylindrical surface intended to rest on the seat 14, which constitutes a half-portion of the static hinge. The other half-portion of the static hinge is formed by the execution of a casting between the seat 14 and the free ends of the portion 22 of the members 18, 19. When the casting is hardened, it defines the second half-portion of the static hinge, the shape of which corresponds and is complementary to that one of the first half-portion. Preferably, a packing of anti-friction material, for example constituted by a sheet of high-density polyethylene (not illustrated), is interposed between the two half-portions of the hinge before the casting intended to form the second half-portion of the static hinge is executed.

The bracket cover portion 26 has a hollow substantially U shaped cross-sectional section, delimited downwardly by a bottom 30 and sideways by a pair of sidewalls 32 which extend perpendicularly to the bottom 30. The sidewalls 32 are preferably tapered so that their height decreases towards the free end 24 of the portion 26. The bottom 30 and the sidewalls 32 define a channel 34 which is open at the free end 24. The channel 34 is intended to receive a portion of a casting 36, executed during the work, so as to be superimposed to the members 18 and 19 of each segment 15 of the work.

Conveniently, secondary reinforcing rods 38, intended to be incorporated in the casting 36, extend upwardly from the sidewalls 32 of the bracket portion 26.

Figure 3:
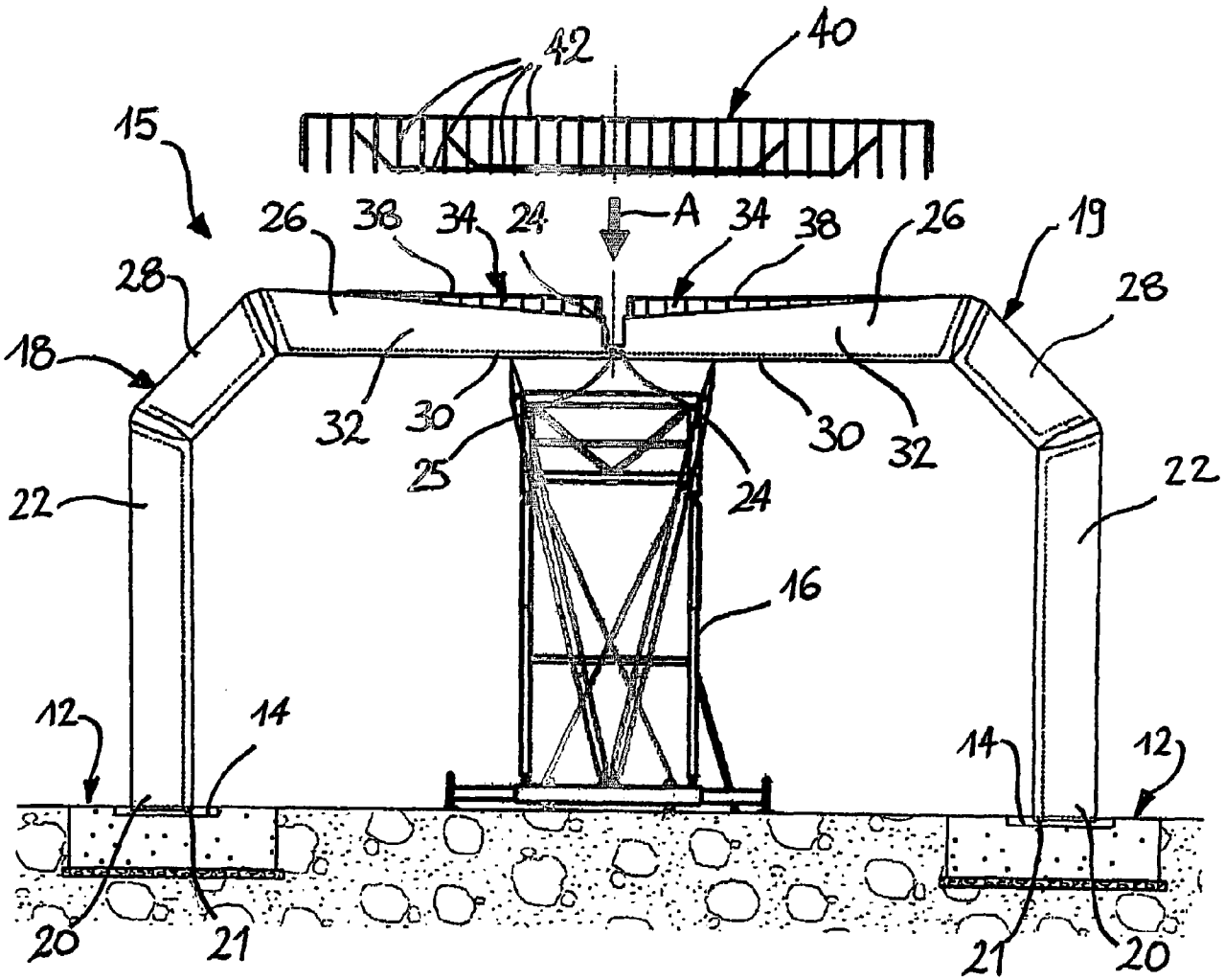
FIGS. 3 and 4 are enlarged views similar to those of FIGS. 1 and 2, showing other manufacturing phases of a work according to the invention.
Figure 4:
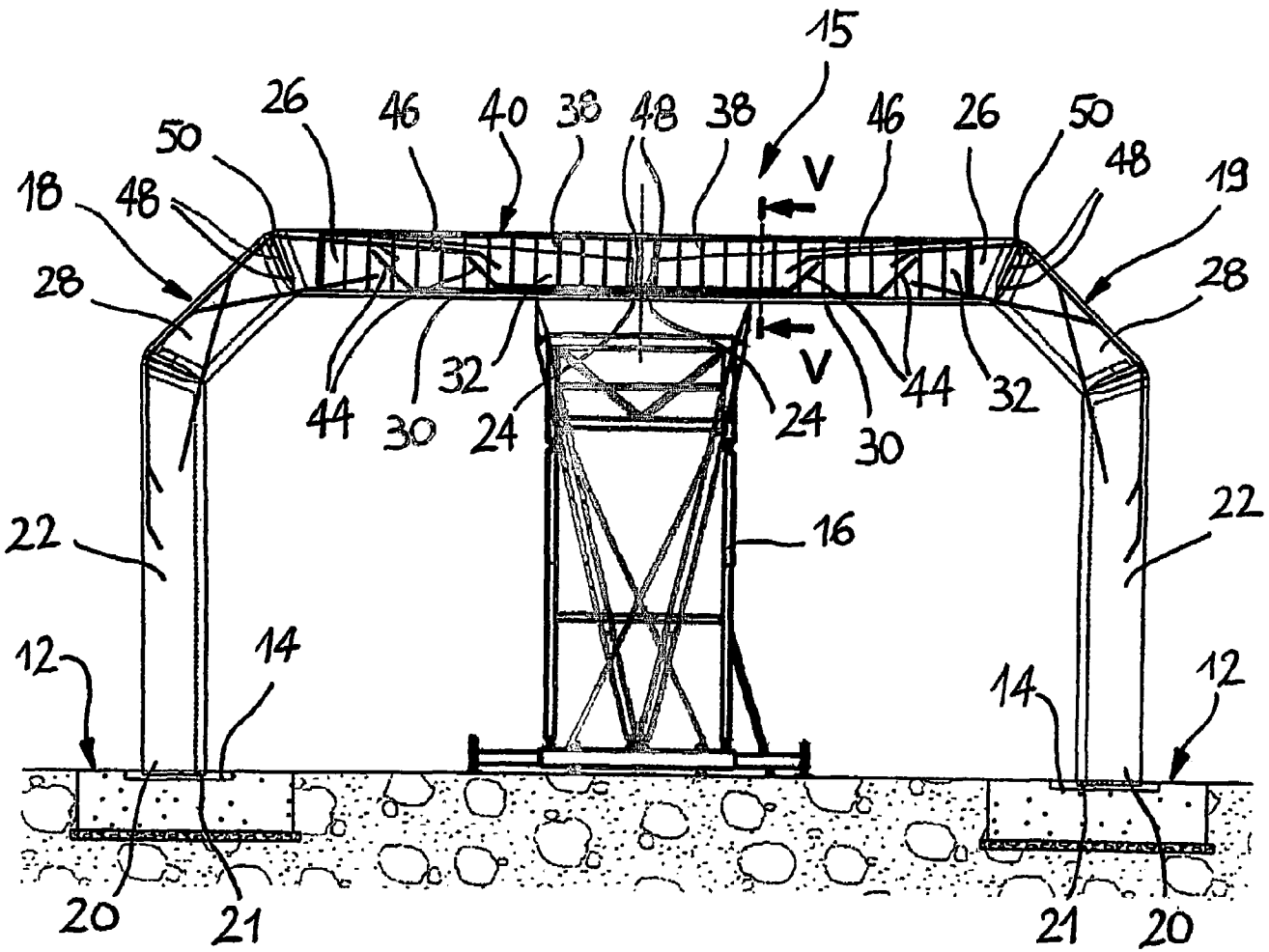

Preferably, an additional reinforcement 40, constituted by auxiliary reinforcing rods 42, is inserted inside the channel 34 before the execution of the casting 36, as schematically indicated by arrow A of FIG. 3.

Figure 5:
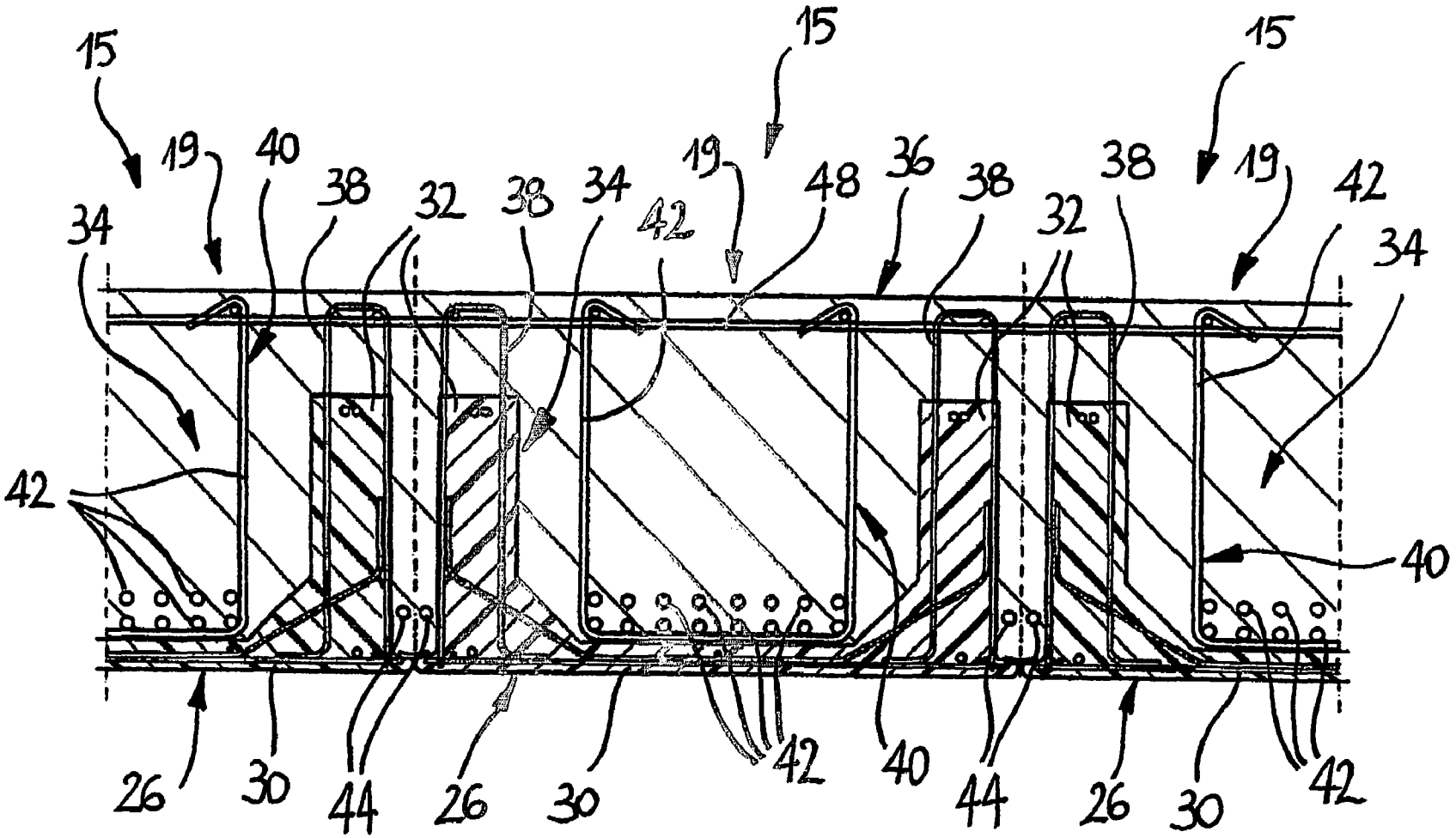
FIG. 5 is a sectional view in greater scale, along line V-V of FIG. 4, and FIGS. 6 and 7 are front elevational views similar to FIGS. 1 and 2, showing further manufacturing phases of a work according to the invention.
Figure 6:
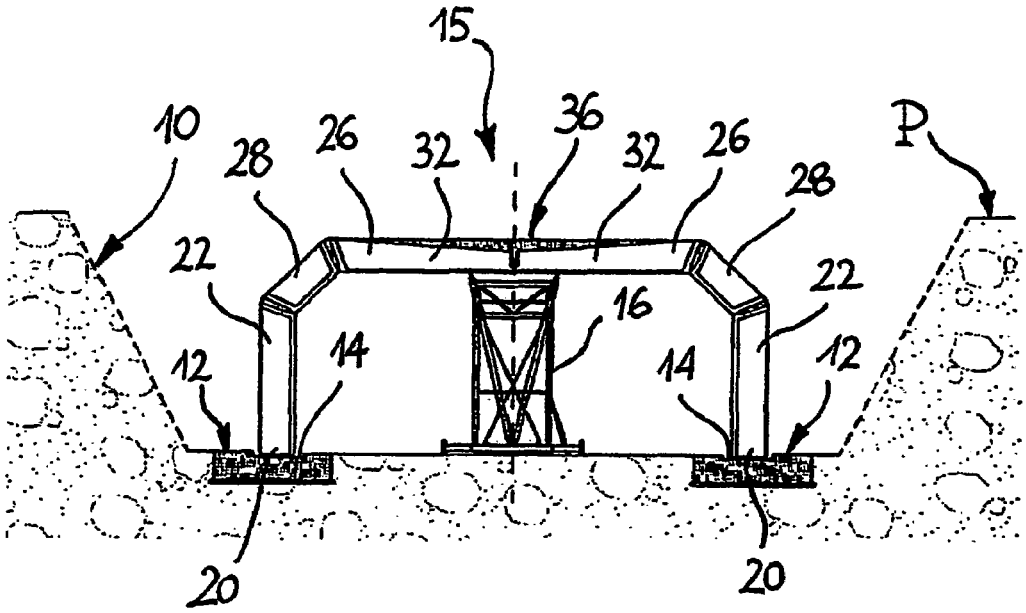
Figure 7:
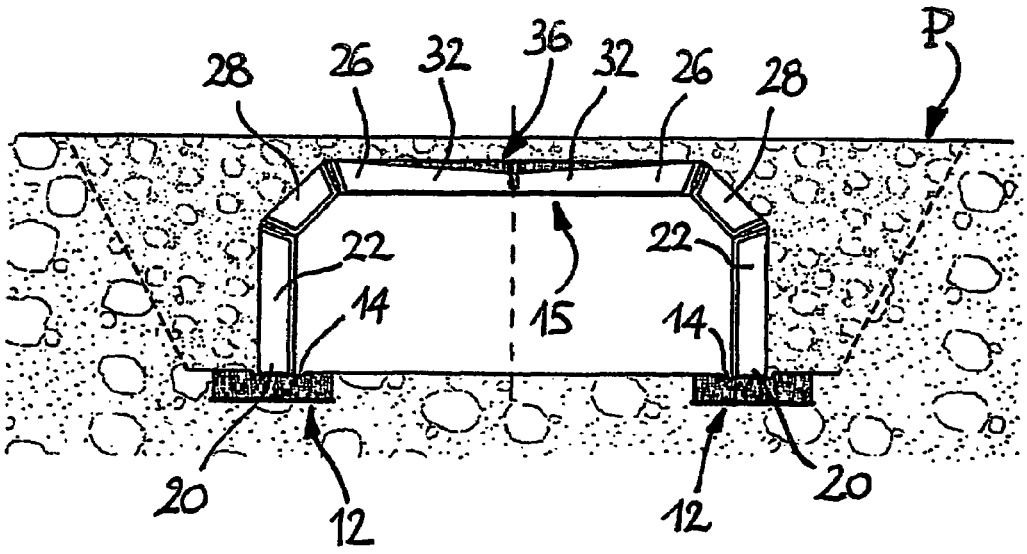

The casting 36 can be advantageously executed in order to form simultaneously a single slab for a plurality of contiguous segments 15 of the work, as more clearly illustrated in FIG. 5. In such a manner, the casting 36 constitutes a single slab of the work and concurs to provide an effective cross-sectional connection of the segments 15. To such a purpose, before the casting 36 is executed and before the rectilinear reinforcements 40 are inserted in the respective channels 34 of the structure, also reinforcing rods 44 and 46 are inserted both transversely to the axis of the work in a position interposed between the contiguous segments 15 and above the reinforcements 40, as well as longitudinal reinforcing rods 48 in proximity of the free ends 24 of the cover portions 26, in correspondence of spaces 50 defined between adjacent bodies of the structural members 18 and 19, and upon the rectilinear reinforcements 40.

When the casting 36 is hardened, the space remaining between the bottom and the sides of the digging 10 and the outside flanks of the work can be filled up so as to restore the embankment to the ground level P, on the completed work.

The invention claimed is:

1. A process for the construction of a segment of an open-air work by prefabricated structural members of reinforced concrete, comprising the steps of:

arranging a first and a second prefabricated structural members, each of which includes an upright portion and at least a cover portion connected to the upright portion, installing the first structural member by resting a free end of its upright portion on a respective foundation portion, installing the second structural member by resting a free end of its upright portion on a respective foundation portion, in such a manner that the two structural members are arranged symmetrically so that the free ends of the cover portions thereof are arranged mutually opposite and in substantial contact to each other, both said structural members being so shaped that the cover portions thereof define respective elongated cavities which are open upwards and are axially open at their free ends, and extend substantially on the overall length of said cover portions, said cavities of the two structural members being arranged, during the installation step, so that they are substantially aligned in order to constitute a continuous elongated channel open upwards wherein a casting is executed during the work in order to make a continuous beam within said elongated channel, said beam being superimposed to both the structural members and fastened to them.

2. The process according to claim 1, wherein each structural member is a prefabricated member which includes a plurality of reinforced concrete bodies connected to each other by means of main reinforcing rods projecting between adjacent reinforced concrete bodies, each structural member being adapted to be articulated as a result of the bending of the main reinforcing rods, and wherein the step of installing the structural members comprises the bending of the main reinforcing rods until both the structural members assume a substantially overturned-L configuration.

3. The process according to claim 1, further comprising the step of inserting a rectilinear reinforcement constituted by auxiliary reinforcing rods in the channel defined by said elongated cavities of the cover portions, before the casting for forming the beam superimposed to the two structural members is executed during the work.

4. The process according to claim 1, further comprising the step of inserting reinforcing rods transversely to the axis of the work between contiguous segments of the work, and reinforcing rods parallel to the axis of the work in proximity of the free ends of the cover portions of the structural members and in correspondence of spaces defined between adjacent bodies of the structural members, and the phase of making simultaneously during the work a plurality of beams superimposed to respective segments of the work, by means of a single concrete casting, so that the structural members of each segment and a plurality of contiguous segments of the work are connected to each other.

5. The process according to claim 4, wherein each structural member has an appendage defined at the free end of its upright portion by a cylindrical surface, and wherein the step of installing each structural member comprises the operation of forming, on the respective foundation portion, a cylindrical seat corresponding to said appendage by means of a concrete casting executed during the work between the structural member and the respective foundation portion, so that a static hinge for the articulation of the structural member with respect to the foundation portion is made, a packing of anti-friction material being preferably interposed between said appendage and said cylindrical seat.

6. A prefabricated structural member for manufacturing a segment of an open-air work, comprising:

an upright portion for resting the structural member on a foundation portion, and at least a cover portion connected to the upright portion, said cover portion defining an elongated cavity which is open upwards and is axially open at its free end opposite to the upright portion, and extends substantially on the overall length of the cover portion, said cavity receiving a portion of a continuous beam made by means of a casting executed during the work in order to be superimposed to a pair of structural members arranged symmetrically opposed and in substantial contact to each other at the free ends of their cover portions, in order to fasten to each other the cover portions of said structural members.

7. A structural member according to claim 6, further comprising a plurality of prefabricated bodies of reinforced concrete, which are connected to each other by means of main reinforcing rods projecting between adjacent reinforced concrete bodies, in such a manner that the structural member can be articulated as a result of the bending of the main reinforcing rods in correspondence of zones between adjacent reinforced concrete bodies.

8. A structural member according to claim 7, wherein said reinforced concrete bodies include a first rectilinear end body defining an upright portion, an intermediate body defining a slanted portion in the condition installed of the structural member, and a second rectilinear end, body defining a bracket portion, said bracket portion having a substantially U shaped cross-sectional section which defines a longitudinal channel which open upwards, the free end of which, directed opposite to said intermediate body, being axially open.

9. A structural member according to claim 8, wherein said longitudinal channel is delimited sideways by tapered sidewalls having a height which decreases towards the free end of the bracket portion.

10. Structural member according to claim 9, wherein secondary reinforcing rods extend from said tapered sidewalls.

11. A structural member according to claim 10, further comprising adjustable extension bearing members at the free end of the bracket portion, in order to allow to change the distance thereof from another structural member arranged symmetrically and the respective opposite bracket portion.

12. A structural member according to claim 10, wherein said upright portion has an appendage at the free end, which defines a convex cylindrical surface for resting in a seat of corresponding shape manufactured during the work on a foundation portion in order to rest the structural member, a packing of antifriction material being interposed between said appendage and said corresponding seat.

* * * * *